US005158210A

United States Patent [19]

Du

[11] Patent Number: 5,158,210

[45] Date of Patent: Oct. 27, 1992

[54] CONDIMENT DISPENSING DEVICE

[76] Inventor: Benjamin R. Du, 32392 Via Antibes, South Laguna, Calif. 92677

[21] Appl. No.: 830,113

[22] Filed: Jan. 30, 1992

Related U.S. Application Data

[63] Continuation of Ser. No. 537,509, Jun. 13, 1990.

[51] Int. Cl.[5] ..... B07D 5/60

[52] U.S. Cl. ..... 222/134; 222/136; 222/144.5; 222/334; 222/341; 222/417; 222/395; 417/395

[58] Field of Search ..... 222/134–136, 222/144.5, 309, 341, 334; 417/395, 394, 401, 566; 251/900, 321; 137/625.61

[56] References Cited

U.S. PATENT DOCUMENTS

| | | | |
|---|---|---|---|
| 3,749,527 | 7/1973 | Slagle | 417/395 |
| 3,830,405 | 8/1974 | Jaeger | 222/144.5 |
| 4,111,614 | 9/1978 | Martin | 417/420 |
| 4,124,147 | 11/1978 | Priese et al. | 222/135 |
| 4,127,365 | 11/1978 | Martin | 417/310 |
| 4,163,164 | 7/1979 | Pieters | 310/103 |
| 4,165,206 | 8/1979 | Martin et al. | 417/310 |
| 4,619,378 | 10/1986 | De Man | 222/144.5 |
| 4,753,370 | 6/1988 | Rudick | 222/105 |
| 4,930,555 | 6/1990 | Rudick | 222/135 |

OTHER PUBLICATIONS

Liqui-Box/B-Bar-B Corporation, Liqui-Box Pressure Pak Dispensing System, 4 pages.

*Primary Examiner*—Andres Kashnikow
*Assistant Examiner*—Philippe Derakshani
*Attorney, Agent, or Firm*—Stetina and Brunda

[57] ABSTRACT

An improved condiment dispensing system for delivering a measured quantity of condiment at a constant flow rate. The device comprises a pump which is fluidly connected to a condiment source and a dispensing apparatus. The dispensing apparatus includes a valve assembly which is connected to both a pressurized fluid source and to the pump whereby actuation of a valve assembly contained on the surface of the dispensing apparatus causes a measured quantity of condiment to be dispensed from an outlet nozzle contained thereon.

11 Claims, 2 Drawing Sheets

CONDIMENT DISPENSING DEVICE

This application is a division of application Ser. No. 07/537,509, filed Aug. 13, 1990.

FIELD OF THE INVENTION

This invention relates to an improved fluid driven pump apparatus and method for pumping a viscous product, such as condiments used in the food service industry. More particularly, the present invention relates to a pumping apparatus and method for providing a variable volume, low flow rate of highly viscous materials without mixing the driving fluid or other impurities into the product being pumped.

BACKGROUND OF THE INVENTION

As is well known, a variety of products typically marketed by fast-food retail establishments are provided to consumers after having been prepared with condiments such as ketchup, mustard, mayonnaise, or relish. In this regard, many such establishments currently utilize manual dispensing systems for such condiments which deliver a metered quantity of condiment therefrom.

The majority of prior art condiment dispensing systems have comprised a portable, hand-held manually activated dispensing devices which are used to supply a quantity of the condiment to a food product. Although such prior art dispensing systems have generally proven suitable for their intended purposes, they possess inherent deficiencies which have detracted from their overall effectiveness and use in the trade.

The foremost of these deficiencies has been the inability of the prior art dispensing system to dispense more than one variety of condiment, in that such devices are typically suited for dispensing only one condiment at a time. Moreover, the dispensing devices currently known are generally hand-held, mechanical devices, having a storage hopper for the condiment thereof. Due to the relatively small size of the hopper necessary to permit proper handling and manipulation by the user, such devices must be refilled frequently with the condiment. This repeated refilling operation decreases operational effectiveness and gives rise to a greater likelihood of condiment contamination whereby the device is more susceptible to having a foreign material introduced thereinto during a refilling operation.

Thus, there exists a substantial need in the art for a reliable, relatively inexpensive apparatus and method for dispensing a variety of condiments through a single dispensing unit in a metered quantity and at a low flow rate, which is adapted to be connected directly to corresponding modern, sanitary bag-in-box containers for such condiments, thereby eliminating repeated refillings of the dispensing system and reducing the possibility of condiment contamination.

SUMMARY OF THE INVENTION

The present invention specifically addresses and overcomes the deficiencies associated with prior art condiment dispensing devices. More particularly, the present invention provides a fluidic driven pump having a housing defining a first cavity and a second cavity. Disposed within the first cavity is a piston/diaphragm which is reciprocally movable through intake and exhaust strokes within the first cavity for pumping a condiment therefrom. The piston/diaphragm is attached to a piston/diaphragm support member which is slidably positioned within the second cavity. The first cavity further includes a product inlet and a product outlet which are in fluid communication therewith. During operation of the pump, the first cavity is in fluid communication with the inlet via a unidirectional check valve during an intake stroke of the piston and is in fluid communication with the outlet via a unidirectional check valve during an exhaust stroke of the piston. In this respect the first cavity alternately has a condiment inputted thereto and expelled therefrom as the piston/diaphragm reciprocates in the first cavity. A first biasing spring is also disposed within the first cavity and cooperates with the piston/diaphragm for biasing the piston/diaphragm toward the second cavity when the second cavity is being vented. The housing also includes an adjusting means comprising a cap member which is threadably received onto one end of the housing. This cap is configured such that if rotated in a clockwise direction, the piston/diaphragm stroke will be decreased while rotating the cap in a counter-clockwise direction will increase the piston/diaphragm stroke. In this regard, the increase or decrease of the piston/diaphragm stroke will regulate the quantity of condiment which is inputted into and subsequently discharged from the first cavity of the pump.

Disposed external of the pump housing is a hand-held, portable dispensing apparatus or nozzle having preferably plural valve assemblies disposed thereon, each of which is fluidly connected to a respective fluid driven pump to actuate pumping cycles for multiple condiments. Each valve assembly includes plural passages formed therein which are configured to alternatively supply and vent a pressurized fluid to the second cavity of a respective pump and deliver a quantity of desired product therefrom. The valve assembly additionally includes at least one reciprocable valve stem which is slidably mounted therein, i.e. movable between a first position and a second position to actuate the pumping cycle of a respective pump.

When in the first position, the valve stem is operable to apply a pressurized fluid into the second cavity of a respective pump through a port contained within the housing, thereby actuating the piston/diaphragm through an exhaust stroke and pushing the condiment from the first cavity through the product outlet. When in the second position, the valve stem is operable to allow the fluid contained within the second cavity to be vented to ambient atmosphere. In this regard, the intake stroke of the piston is facilitated by the action of the first biasing spring. During this intake stroke, a quantity of condiment is intaked into the first cavity by means of the product inlet which is attached to a bag-in-box containing a condiment. The product outlet is connected back to the dispensing apparatus whereby the condiment is disposed or output onto a food product through a dispensing aperture contained within the apparatus. Importantly, in the preferred embodiment of the present invention, the dispensing apparatus includes three valve stems sharing a common first pressurized fluid inlet passage. Additionally, multiple, i.e. three, pumps are included wherein each is connected to a different condiment source. Thus, the hand-held dispensing apparatus is configured to be able to independently dispense multiple, i.e. three, different types of condiments therefrom.

The present invention is economical, relatively mechanically simple, and is highly reliable in long-term continuous operation.

BRIEF DESCRIPTION OF THE DRAWINGS

These as well as other features of the present invention will become apparent upon reference to the drawings wherein.

DETAILED DESCRIPTION OF THE PREFERRED EMBODIMENT

Figure 1:
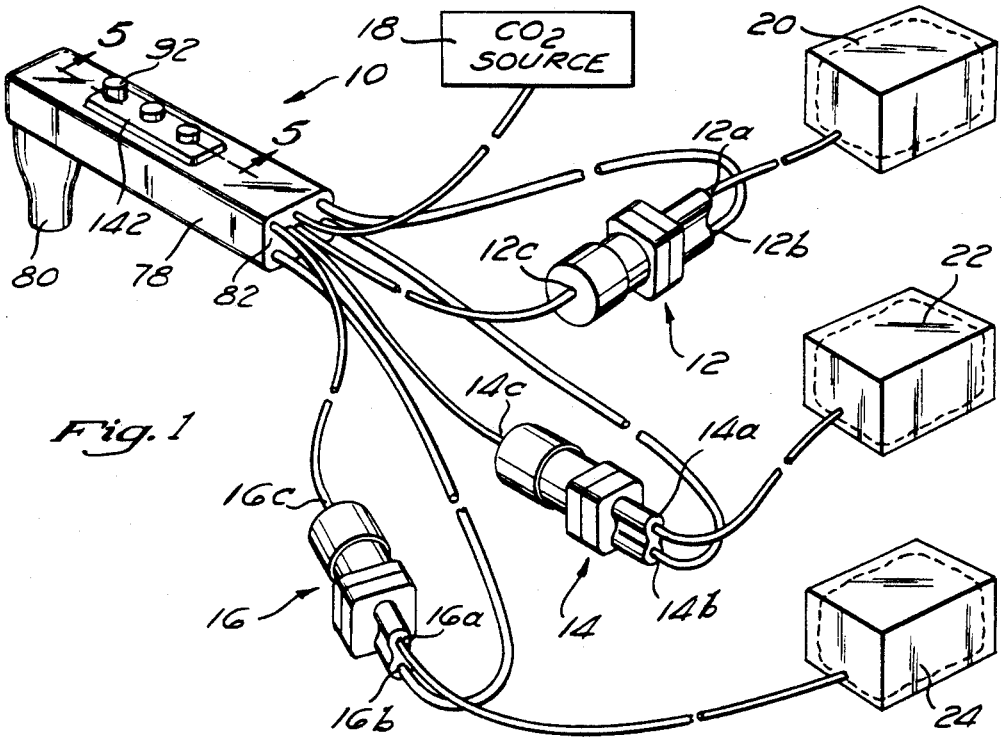
FIG. 1 is a perspective representation of a condiment dispensing system.

Referring now to the drawings wherein the showings are for purposes of illustrating a preferred embodiment of the present invention only, and not for the purposes of limiting the same, FIG. 1 perspectively illustrates the condiment dispensing system according to the present invention. In the preferred embodiment of the present invention, the dispensing system generally comprises a dispensing apparatus 10 fluidly connected to plural pumps, for instance a first pump 12, a second pump 14, and a third pump 16. Also connected to dispensing apparatus 10 is a pressurized fluidic source, preferably carbon dioxide gas source 18. Pump 12 is also connected to a first condiment containing bag-in-box storage reservoir 20, while second pump 14 is connected to a second bag-in-box reservoir 22, and third pump 16 is connected to a third bag-in-box reservoir 24. In operation, actuation of the dispensing apparatus 10 causes a quantity of condiment to flow from a respective bag-in-box 20, 22, 24 through pumps 12, 14, 16 and into dispensing apparatus 10, as will be described in greater detail below.

PUMP CONFIGURATION

Figure 4:
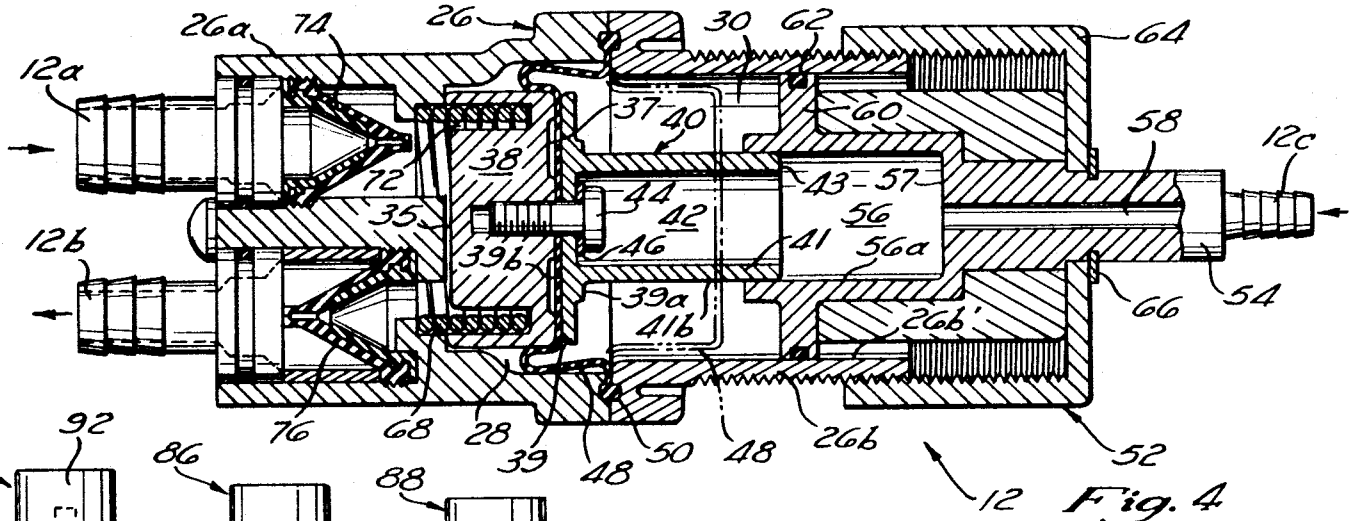
FIG. 4 is a cross-sectional view of the pump according to the preferred embodiment, showing relative positions of the piston during operation thereof.

Referring now to FIG. 4, a cross-sectional view of pump 12 is illustrated. It should be noted that pumps 12, 14, 16 have identical configurations and that pump 12 was arbitrarily selected to be described with regard to FIG. 4. Pump 12, according to the present invention, includes a pump housing 26 generally consisting of a first housing section **26*a* and a second housing section 26*b*. Defined within first housing section 26*a* is a first cavity 28 and within second housing section 26*b* is a second cavity 30. First housing section 26*a* further includes a product inlet 12*a* and a product outlet 12*b* adjacent the closed end thereof. Pump housing 26 is formed of first section 26*a* and second section 26*b*** for ease of manufacture and assembly of components, and further for convenience of inspection, cleaning, and maintenance.

Disposed within first housing section **26*a* is a piston 38 which is adapted to be reciprocally moveable therein. Piston 38 is positioned within first housing section 26*a* so as to be in axial alignment with first cavity 28. In FIG. 4, piston 38 is shown at the outer limit (i.e. full exhaust stroke) of its range of motion and also illustrated at the inner limit of its range of motion (shown in phantom lines). When piston 38 moves toward its inner limit, fluid enters the product inlet 12*a* and subsequently into first cavity 28. When piston 38 moves toward its outer position, the fluid is pushed by piston 38 through product outlet 12*b***.

The lower surface 37 of piston 38 is mounted to a piston support member 40. Piston support member 40 is generally comprised of a circular plate member 39 having an inner surface **39*a* and an outer surface 39*b*. Extending axially outwardly from inner surface 39*a* is a tubular member 41 which is attached thereto, and defines a pressurized air receiving cavity 42. Piston 38 is attached to piston support member 40 by means of a fastener 44 which is received into a threaded aperture disposed within lower surface 37 of piston 38. A gasket 46 is provided between fastener 44 and inner surface 39*a* of support member 40 to provide an air-tight seal therebetween. Additionally, a rolling diaphragm 48 is positioned between lower surface 37 of piston 38 and outer surface 39*b* of circular plate member 39. An outer edge 50 of rolling diaphragm 48 is further secured between first housing section 26*a* and second housing section 26*b*. Importantly, rolling diaphragm 48 moves with piston 38 and piston support member 40, as piston 38 reciprocates relative to pump housing 26**.

Second cavity 30 of second housing section **26*b* is enclosed through the utilization of a seal assembly 52 which is threadably attached to the threaded portion of the outer surface of second housing section 26*b*. Seal assembly 52 generally comprises a sealing member 54 which defines a generally cylindrical recessed portion 56, a channel 58, and a circular outer flange 60. One end of channel 58 terminates into recessed portion 56, while the other end terminates into a carbon dioxide inlet/exhaust port 12*c*. Sealing member 54 is disposed within second housing section 26*b* such that the outer edge of outer flange 60 is in direct contact with the inner surface 26*b*' of second housing section 26*b*. Outer flange 60 includes an O-ring 62 disposed within a slot contained in the outer periphery thereof to facilitate the seal between sealing member 54 and inner surface 26*b*'. Sealing member 54 is attached to a cap member 64 through the utilization of a snap ring 66. The interior threaded portion of cap member 64 is sized and configured to threadably engage the outer threaded surface of second housing section 26*b*. Importantly, when cap member 64 is placed on second housing 26*b*, piston support member 40 and sealing member 54 are configured such that circular receiving cavity 42 and cylindrical recessed portion 56 as well as channel 58 are axially aligned whereby outer surface 41*b* of tubular member 41 is in sliding contact with inner surface 56*a* of recessed portion 56. As can be appreciated with this particular alignment, the intake stroke of piston 38 will be stopped when outer edge 43 of tubular member 41 is abutted against surface 57 of recessed portion 56. In this respect, the clockwise rotation of cap member 64 will cause sealing member 54 to move inwardly toward piston 38 thereby reducing the stroke of piston 38. Conversely, the counter-clockwise rotation of cap member 64 will cause sealing member 54 to move outwardly away from piston 38, thereby increasing the stroke of piston 38. By increasing or decreasing the stroke of piston 38, the volume of first cavity 28 is likewise increased or decreased. Thus, the quantity of condiment that is outputted by the dispensing system may be adjusted through the rotation of sealing assembly 52**.

Piston 38 is actuated by pressurized fluid, preferably carbon dioxide, entering inlet/exhaust port **12*c***. After entering through port 12*c*, the fluid travels through channel 58 and enters receiving cavity 42 of piston support 40. It will be appreciated that initially only receiving cavity 42 is filled with fluid, since at the beginning of the exhaust stroke, lower edge 43 of tubular member 41 will be abutted against surface 57 of recessed portion 56. Fluid within receiving cavity 42 then presses against the exposed surface of fastener 44 thereby moving piston 38 through an exhaust stroke. The exhaust stroke of piston 38 is limited by a biasing spring 68, one end of which is abutted against a lip 70 contained within first housing section 26*a* and the other end of which is retained within a circular notch 72 disposed within the upper surface 35 of piston 38. As can be appreciated, after piston 38 has completed its exhaust stroke, the inlet stroke is facilitated by the action of biasing spring 68 returning to an extended position when the pressurized air then contained within receiving cavity 42, recessed portion 56, and channel 58 is exhausted through port 12*c*.

Condiment product entering first cavity 28 through product inlet 12*a* during an intake stroke of piston 38 first passes through an inlet check valve 74. Similarly, condiment product pushed by piston 38 through product outlet 12*b* during an exhaust stroke of piston 38 passes through outlet check valve 76. During operation of pump 12, during an intake stroke, inlet check valve 74 opens and outlet check valve 76 closes. Conversely, during an exhaust stroke, outlet check valve 76 opens while inlet check valve 74 closes.

DISPENSING APPARATUS CONFIGURATION

Figure 2:
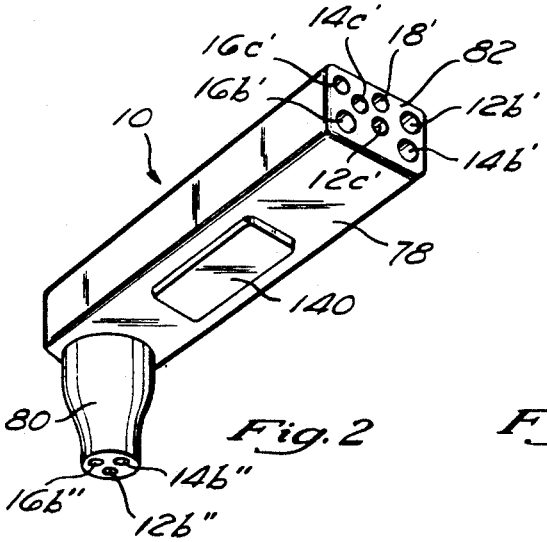
FIG. 2 is a perspective view of the dispensing apparatus used in conjunction with the dispensing system.
Figure 3:
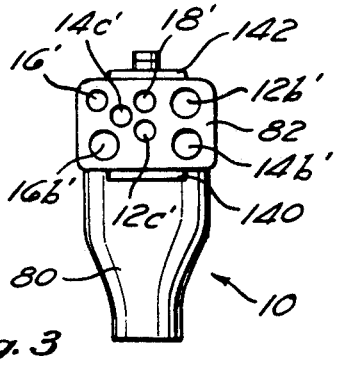
FIG. 3 is an end view illustrating the input and output ports of the dispensing apparatus shown in FIG. 2.

Referring now to FIGS. 1–3, dispensing apparatus 10 generally comprises a handle portion 78 and an outlet nozzle 80. Disposed within an end surface 82 of handle portion 78 are a plurality of apertures which are interfaced to pumps 12, 14, 16 and carbon dioxide source 18 as will be discussed in greater detail below. The control of condiment flow through dispensing device 10 is regulated by a valve configuration disposed within handle portion 78.

Figure 5:
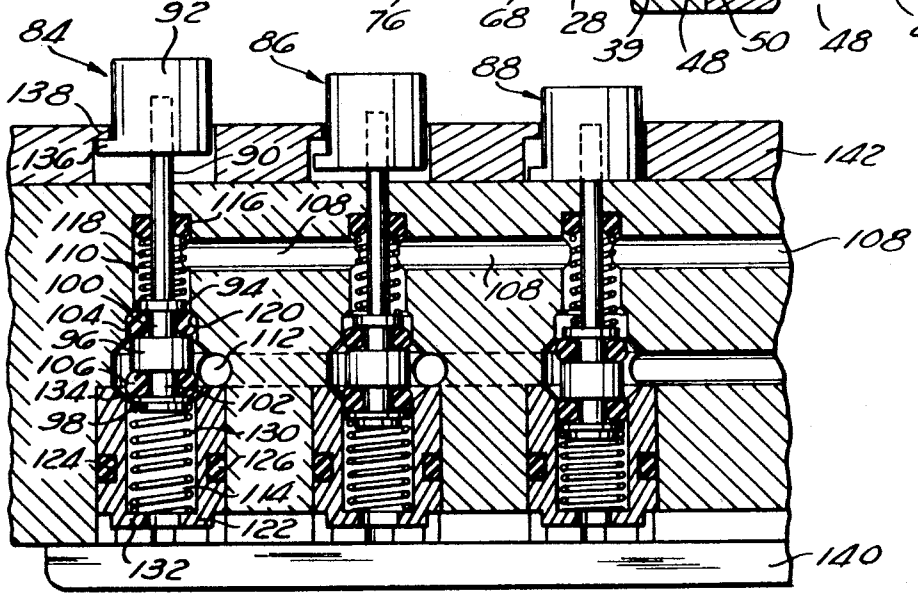
FIG. 5 is a cross-sectional view of the dispensing apparatus taken along line 5—5 of FIG. 1, illustrating the valve assembly including the valve stems and flow passages.

Referring now to FIG. 5, the valve configuration generally comprises a first valve stem assembly 84, a second valve stem assembly 86, and a third valve stem assembly 88. Each of the valve stem assemblies 84, 86, 88 have identical configurations and therefore the particular structures associated with each such assembly will be described with respect to valve stem assembly 84, though it will be appreciated that this particular assembly has been selected arbitrarily. Valve stem assembly 84 generally comprises an elongated valve stem 90 having a manual actuation button 92 disposed on one end thereof. Valve stem 90 further includes a first flange 94, a second flange 96, and a third flange 98 which extend radially outwardly about the periphery of various portions of valve stem 90. First flange 94 and second flange 96 define a first annular slot or recess 100 which extends about the periphery of valve stem 90 while second flange 96 and third flange 98 define a second annular slot or recess 102 which likewise extends about the periphery of valve stem 90. Disposed within first annul-ar slot 100 is a first O-ring 104 and disposed within second annular slot 102 is a second O-ring 106.

Valve stem assembly 84 is used in conjunction with a first air passage 108, a second air passage 110, a third air passage 112, and a fourth air passage 114. Contained within the upper region of second passage 110 is an O-ring 116 which creates a seal between the upper portion of valve stem 90 and an interior surface of handle portion 78. Also contained within second passage 110 is a first biasing spring 118, one end of which is abutted against third O-ring 116 and the other end of which is abutted against first flange 94 of valve stem 90. The lower region of second passage 110 includes a first annular lip 120 extending about the diameter thereof, which is adapted to form a sealing surface with first O-ring 104. Fourth air passage 114 is disposed within an exhaust member 122 inserted into handle portion 78, whereby fourth air passage 114 is axially aligned with second air passage 110. Exhaust member 122 is utilized so as to facilitate a less complicated manufacturing process with regard to the fabrication of the various air passage configurations utilized in conjunction with valve stem assembly 84. Exhaust member 122 includes a notch 124 extending about the periphery of the outer surface thereof into which is disposed a fourth O-ring 126. Fourth O-ring 126 is used to provide an air-tight seal between exhaust member 122 and an interior surface of handle portion 78. Disposed within the bottom wall 132 of exhaust member 122 is an exhaust port 128 which is used to vent pressurized fluid within the valve stem assembly 84 to the ambient environment, as will be explained in greater detail below. The exhaust ports of each of the valve stem assemblies 84, 86, 88 are covered by an exhaust cover 140, as best seen in FIGS. 2 and 5. Disposed within fourth passage 114 is a second biasing spring 130, the upper end of which is abutted against third flange 98 of valve stem 90 and the lower end of which is abutted against bottom wall 132 of exhaust member 122. Exhaust member 122 further includes a second annular lip or seat 134 disposed about the diameter of the upper end thereof which is adapted to form a sealing contact with second O-ring 106.

As can be seen in FIG. 5, valve stem assemblies 84, 86, 88 are each shown in various stages of actuation wherein valve stem assembly 84 is in a fully unactuated position, valve stem assembly 86 is in an intermediate stage of actuation, and valve stem assembly 88 is shown as being fully actuated. In the unactuated position, shown by valve stem assembly 84, button 92 is maintained in a fully upright position due to the action of second biasing spring 130 contained within fourth passage 114. Button 92 is contained within switch plate 142 attached to handle portion 78 through the utilization of a projection 136 contained on the lower end of button 92 which catches on a lip 138 disposed within the upper surface of switch plate 142.

When pressurized fluid is injected into dispensing apparatus 10, the fluid travels along first passage 108 whereby such pressurized air is injected into second passage 110 of valve stem assembly 84. As can be appreciated, such pressurized fluid will also be injected from first passage 108 into the passages of valve stem assemblies 86, 88 corresponding to second passage 110, though such second passage has only been specifically described with respect to valve stem assembly 84. As best seen with respect to valve stem assembly 84, when a valve stem is in a fully unactuated position, first O-ring 104 is sealed against first annular lip or seat 120 due to the action of second biasing spring 130, thereby confining, i.e. valving, the inputted fluid within first passage 108 and second passage 110. At the same time, fourth passage 114 is opened, i.e. O-ring 104 is raised above the seat 134, thus allowing the fluid to be vented from third passage 112 into the ambient air through exhaust port 128. As can be best seen with respect to the configuration shown by valve stem assembly 86, as button 92 is being depressed by the finger of an operator of the dispensing system, first O-ring 104 is slowly moved away from first annular lip or seat 120 second biasing spring 130 is being compressed. Importantly, as first O-ring 104 is being moved away from first annular lip 120, second O-ring 106 is simultaneously moved toward second annular lip or seat 134. As can be best seen with respect to the configuration shown by valve stem assembly 88, when button 92 is fully depressed, an open fluid passageway is formed between first passage 108, second passage 110, and third passage 112, thus pressurizing third passage 112. At the same time, fourth passage 114 will be valued, i.e. blocked, by the seal created by second O-ring 106 against second annular lip or seat 134.

DISPENSING SYSTEM OPERATION

Having thus described the structure of pumps 12, 14, 16. and dispensing apparatus 10, the flow patterns and operation of the dispensing system will now be described.

Referring now to FIGS. 1–4, pressurized fluid from the carbon dioxide gas source 18 is applied into dispensing apparatus 10 through aperture 18' contained in end face 82. To facilitate the exhaust stroke of piston 38, valve stem 90 is fully actuated as shown in valve stem assembly 88. As previously described with regard to the actuated position, fluid from carbon dioxide source 18 entering handle portion 78 through aperture 18' will enter and travel through first passage 108, second passage 110, and into third passage 112. From third passage 112 the fluid will exit through aperture **12*c'* and be injected into inlet/exhaust port 12*c*, thereby causing piston 38 to begin an exhaust stroke, i.e. pumping stroke, as previously described, thus pushing the condiment out of product outlet 12*b*. From outlet 12*b* the condiment is forced into dispensing apparatus 10 by way of aperture 12*b'* and will exit dispensing apparatus 10 through aperture 12*b''* contained within outlet nozzle 80. After the exhaust stroke has been completed, button 92 is returned to the unactuated position shown by valve stem assembly 84. Due to the configuration of the air passages with respect to the unactuated Position as previously described, the action of biasing spring 68 in first cavity 28 of pump 12 initiates the intake stroke of piston 38 thereby pushing the residual pressurized fluid within cavity 42, recessed portion 56, and channel 58 out through inlet/exhaust port 12*c*. From inlet/exhaust port 12*c* the fluid will enter handle portion 78 through aperture 12*c'*, and travel into third passage 112, fourth passage 114, and through exhaust port 128, thus being vented into the ambient air. As this venting process is occurring, condiment from bag-in-box 20 will once again enter first cavity 28 through product inlet 12*a* during the intake stroke of piston 38. As can be appreciated, a procedure identical to the aforementioned occurs with respect to inlet/outlet ports 14*a*, 14*b*, 14*c*, of pump 14, and apertures 14*b'*, 14*c'*, and 14*b''* of dispensing apparatus 10, as well as inlet/outlet ports 16*a*, 16*b*, 16*c* of pump 16 and apertures 16*b'*, 16*c'* and 16*b''* of dispensing apparatus 10. Thus, in the preferred embodiment of the present invention, three varieties of condiment may be dispensed from dispensing apparatus 10**, though it will be appreciated that more or less pumps and valve stem assemblies may be utilized to dispense different numbers of condiments with respect to the present dispensing system.

Additional modifications and improvements of the invention may also be apparent to those skilled in the art, as, the particular combination of parts described and illustrated herein is intended to represent only one embodiment of the invention, and is not intended to serve as limitations of alternative devices within the spirit and scope of the invention.

What is claimed is:

1. A condiment dispensing system comprising:

at least one reservoir sized to contain a quantity of condiment therein;

a hand-held dispensing apparatus;

at least one fluid-driven pump fluidly coupled between said reservoir and said dispensing apparatus for pumping condiment from said reservoir to said dispensing apparatus, said pump being adapted to draw a pre-determined quantity of the condiment from the reservoir thereinto and dispense the pre-determined quantity therefrom into the dispensing apparatus; and a valve assembly disposed within said hand-held dispensing apparatus, said valve assembly comprising:

a plurality of fluid passages in fluid communication with said pump; and at least one valve stem, said valve stem being reciprocally movable between first and second positions;

said fluid passages and said valve stem being oriented within said dispensing apparatus in a manner wherein said valve stem is operable to selectively open certain ones of said fluid passages while simultaneously closing others such that said valve stem causes said pump to draw the pre-determined quantity of condiment from the reservoir thereinto when in the first position and dispense the pre-determined quantity therefrom into the dispensing apparatus when in the second position.

2. The dispensing system as defined in claim 1 wherein said fluid-driven pump comprises:

a housing means defining a first cavity and a second cavity;

a piston slidably positioned within said housing means, said piston being reciprocably movable through intake and exhaust strokes within said first cavity for selectively drawing the pre-determined quantity of condiment thereinto and dispensing the pre-determined quantity therefrom into the dispensing apparatus;

an inlet/exhaust port coupled to said housing for supplying a pressurized fluid to said second cavity for initiating the exhaust stroke of said piston and venting the pressurized fluid from the second cavity during the intake stroke of said piston;

a product inlet for placing said first cavity in fluid communication with said reservoir during the intake stroke of said piston;

a product outlet for placing said first cavity in fluid communication with said dispensing apparatus during the exhaust stroke of said piston; and a first spring means disposed within said first cavity, said first spring means cooperating with said piston in a manner operable to bias said piston toward said second cavity when the pressurized fluid is vented therefrom.

3. The dispensing system as defined in claim 2 wherein said fluid-driven pump further includes a means for adjusting the pre-determined quantity of condiment drawn into and dispensed from the pump.

4. The dispensing system as defined in claim 3 wherein said adjusting means comprises a cap member threadably received onto said housing adjacent said second cavity, said cap member being cooperatively engaged to said piston in a manner wherein clockwise rotation of said cap member decreases the piston stroke thereby decreasing the pre-determined quantity of the condiment and counter-clockwise rotation of said cap member increases the piston stroke thereby increasing the pre-determined quantity of the condiment.

5. The dispensing system as defined in claim 2 wherein said hand-held dispensing apparatus is fluidly connected to said inlet/exhaust port in a manner wherein said valve stem is operable to place said second cavity in fluid communication with ambient air when in said first position and in fluid communication with the pressurized fluid when in said second position.

6. The dispensing system as defined in claim 5 wherein said plurality of fluid passages disposed within said hand-held dispensing apparatus comprise:

a first passage in fluid communication with the pressurized fluid;

a third passage in fluid communication with said inlet-/exhaust port;

a second passage fluidly connecting said first passage to said third passage; and a fourth passage fluidly connecting said third passage to ambient air via an exhaust port;

said valve stem being oriented within said dispensing apparatus in a manner wherein said valve stem is operable to open said second passage while simultaneously closing said fourth passage and said exhaust port when in said second position and open said fourth passage and said exhaust port while simultaneously closing said second passage when in said first position.

7. The dispensing system as defined in claim 6 wherein said valve assembly further comprises a second spring means disposed within said hand-held dispensing apparatus, said second spring means being cooperatively engaged to said valve stem in a manner operable to bias said valve stem toward said first position.

8. The dispensing system as defined in claim 6 wherein said at least one reservoir comprises a plurality of reservoirs, each of said reservoirs containing a quantity of a condiment therein, and said at least one fluid-driven pump comprises a plurality of fluid-driven pumps, each of said pumps being in fluid communication with a respective one of said reservoirs.

9. The dispensing system as defined in claim 7 wherein said plurality of reservoirs each comprise a bag-in-box reservoir.

10. The dispensing system as defined in claim 9 wherein said valve assembly comprises a plurality of valve stems, each of said valve stems being in fluid communication with a respective one of said fluid-driven pumps via said fluid passages.

11. The dispensing system as defined in claim 10 wherein said fluid-driven pumps each comprise a carbon dioxide fluid-driven pump.

* * * * *